United States Patent [19]

Lazzerini

[11] Patent Number: 4,653,306

[45] Date of Patent: Mar. 31, 1987

[54] METHOD FOR PREPARING TUBULAR CHILLS FOR CONTINUOUS STEEL CASTING PLANTS

[75] Inventor: Pierluigi Lazzerini, Lucca, Italy

[73] Assignee: Tubi Italia S.p.A., Florence, Italy

[21] Appl. No.: 837,652

[22] Filed: Mar. 5, 1986

Related U.S. Application Data

[63] Continuation of Ser. No. 625,677, Jun. 28, 1984, abandoned.

[30] Foreign Application Priority Data

Dec. 14, 1983 [IT] Italy ..... 68297 A/83

[51] Int. Cl.[4] ..... B21K 21/08

[52] U.S. Cl. ..... 72/370; 72/283; 72/391

[58] Field of Search ..... 72/112, 126, 347, 283, 72/370, 391, 415, 276

[56] References Cited

U.S. PATENT DOCUMENTS

| | | | |
|---|---|---|---|
| 616,357 | 12/1898 | Reynolds et al. | 72/283 |
| 1,775,762 | 9/1930 | Harvey | 72/415 |
| 1,967,487 | 7/1934 | Waisner | 72/283 |
| 2,325,522 | 7/1943 | Lauer et al. | 72/126 |
| 3,602,030 | 8/1971 | Noda et al. | 72/347 |
| 3,646,799 | 3/1972 | Kipp et al. | 72/370 |

*Primary Examiner*—Lowell A. Larson

*Attorney, Agent, or Firm*—Shlesinger, Arkwright, Garvey & Fado

[57] ABSTRACT

A method is described for the preparation of tubular copper or copper-alloy chills or ingot moulds shaped with their longitudinal axis substantially curved, and comprising a first stage in which the end of a tubular semi-finished product of rectilinear axis is turned-over by cold plastic deformation; a second stage in which said semi-finished product is shaped to give it a curved form; a third stage in which a mandrel having the same shape and outer dimensions as the chill to be obtained is then inserted into said semi-finished product; a fourth stage in which said semi-finished product is passed through an extruder die of such dimensions as to deform the material of said semi-finished product in order to cause the inner surface of said semi-finished product to adhere closely to the outer surface of said mandrel; and a fifth stage in which when said semi-finished product has passed through said die, a substantially axial force is exerted on said mandrel in the opposite direction to the force exerted in the preceding stage, while the end edge of said semi-finished product is rested against counter-acting sectors disposed below said die.

15 Claims, 14 Drawing Figures

11
12
15
16
17
18
19
20
21
22
g
3

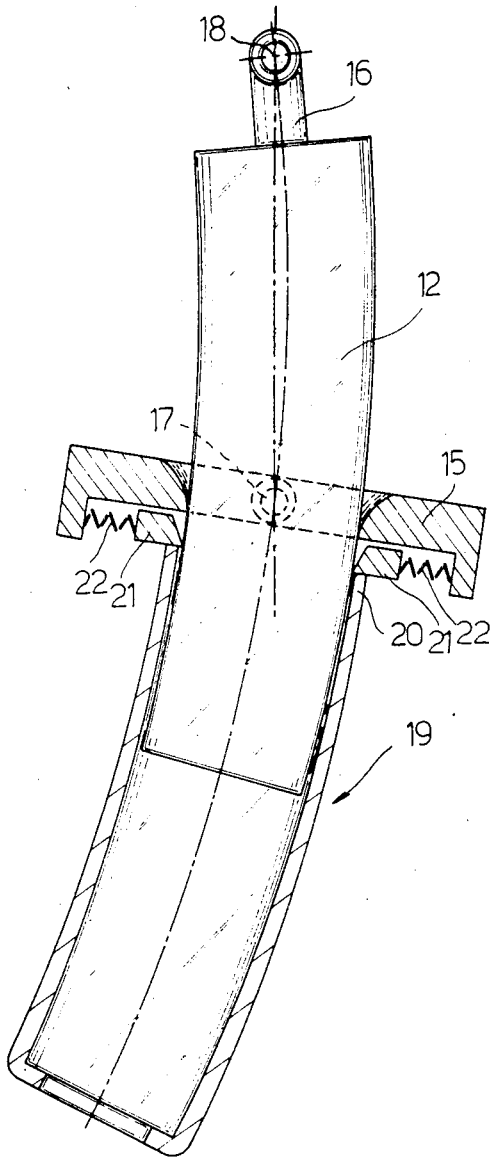
Fig.9
Fig.10
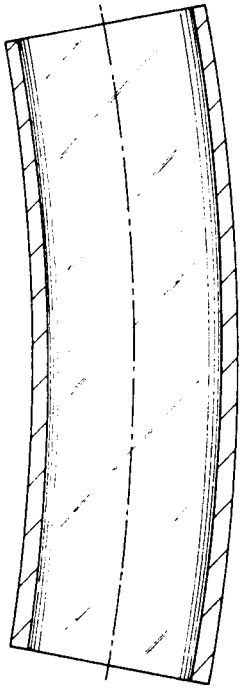

METHOD FOR PREPARING TUBULAR CHILLS FOR CONTINUOUS STEEL CASTING PLANTS

This application is a continuation of application Ser. No. 625,677, filed June 28, 1984 now abandoned.

BACKGROUND OF THE INVENTION

This invention relates to a method for preparing tubular copper or copper-alloy chills or ingot moulds of the type shaped with a substantially curved longitudinal axis, and designed for continuous steel casting plants.

In a continuous steel casting plant, said chills are traversed in known manner by a stream of fluid metal which commences to solidify during its passage therethrough, under the action of energetic cooling produced by circulating a coolant fluid which laps the outer surface of said chills.

In order to effectively perform the functions required of them, chills of this type must have a number of favorable properties. Firstly, they must be provided with internal surfaces of a high degree of hardness and with a finish such as to allow the deposition of a layer of lining material able to effectively resist the wear action deriving from the running of the molten steel, and to enable this running to take place with low friction. In addition, the chill cross-section must decrease gradually along its axis (conical profile), so as to always ensure perfect heat transfer from said surfaces to the coolant medium which laps the outer chill surface. In this respect, it has been found that if this cross-section reduction along the axis is not provided, the metal can separate from the inner chill surface due to the shrinkage of the material solidifying in the most outer layers, this considerably reducing the heat transfer coefficient between the metal and the chill itself.

Chills of the said type are normally prepared from a tubular semi-finished product with a rectilinear axis, formed by simple extrusion or by any other operation. It is then given a curved shape, normally by exerting radial pressures on its outer surface using a mold of suitable form. Then in order to create the required surface finish and the cross-sectional variation along its axis, as is necessary to obtain correct flow of steel along the chill, said surface is machined by millers or grinders of special type which are moved along inside the semi-finished product by means of devices of special shape. In an alternative method, the cross-sectional variation inside the chill is obtained by chemical attack using a suitable chemical agent with which the cavity inside the chill is filled. By decreasing the level of said liquid proportionally to the time, the surface is chemically attacked, resulting in the removal of quantities of material which are proportional to the axial length of the chill. The chills obtained by the aforesaid methods have numerous drawbacks. Firstly, the hardness of the inner surface of the chill is very low and substantially equal to that of the material of the initial semi-finished product. In addition, its surface finish is also not particularly good, especially if subjected to the aforesaid chemical action. Again, the required inner shape of the chill can be obtained only with a certain approximation, this applying particularly to the variation in the inner cross-section along the axis. Finally, the necessary machining in order to prepare chills by the firstly described method can be particularly lengthy, difficult to carry out and generally require special care.

SUMMARY OF THE INVENTION

The object of the present invention is to provide a method for preparing chills or ingot moulds of the aforesaid type, which method obviates the described drawbacks.

This is attained according to the invention by a method for preparing tubular copper or copper-alloy chills or ingot moulds shaped with a substantially curved longitudinal axis and designed for continuous steel casting plants, characterised by comprising:

- a first stage in which the end of a tubular semi-finished product of rectilinear axis is turned-over by cold plastic deformation, in order to form an annular shoulder at that end;
- a second stage in which said semi-finished product is shaped in such a manner as to give it a curved form in which its longitudinal axis assumes a configuration substantially in the form of a circumferential arc, said second stage being effected by applying, in a mould, pressures to the outer surface of the semi-finished product which are directed substantially orthogonally to said axis of said semi-finished product;
- a third stage in which a mandrel of shape and outer dimensions equal to those of the chill to be obtained is then inserted into said semi-finished product and the end of said mandrel is rested on said annular shoulder, the inner dimensions of said semi-finished product of rectilinear axis being chosen substantially greater than the maximum dimensions of said mandrel, in order to leave a predetermined radial gap between the mandrel and semi-finished product;
- a fourth stage in which said semi-finished product is passed through an extruder die of such dimensions as to deform the material of said semi-finished product and cause the inner surface of said semi-finished product to closely adhere to the outer surface of said mandrel, said fourth stage being effected by exerting a substantially axial force on said mandrel so as to transmit said force to the semi-finished product by virtue of the resting of the mandrel on said annular shoulder;
- a fifth stage in which, when said semi-finished product has passed through said die, a substantially axial force is exerted on said mandrel in the opposite direction to the force exerted in the preceding stage, while the end edge of said semi-finished product is made to rest against counteracting sectors disposed below said die.

BRIEF DESCRIPTION OF THE DRAWINGS

The method of the present invention will be more apparent from the description of the basic stages given hereinafter by way of example with reference to the accompanying drawings which diagrammatically represent certain stages of said method and the semi-finished product obtained thereby.

FIGS. 1, 4 and 10 show semi-finished products used or obtained during the method;

FIGS. 2, 3, 5, 6, 7, 8 and 9 are diagrammatic representations of successive stages of the method;

DETAILED DESCRIPTION OF THE INVENTION

A chill obtained by the method of the invention is of the type shown in FIGS. 11 to 14. The chill is substantially in the form of a tubular element with its axis curved, for example in the form of a circumferential arc (FIG. 11), and with its inner cross-section decreasing along said axis. Said cross-section can be of any shape, for example square, as shown in the figures.

Figure 1:
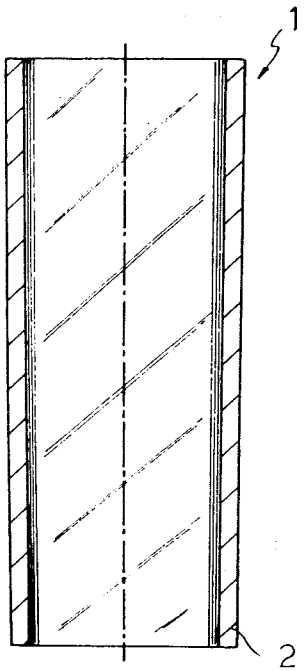
Figure 11:
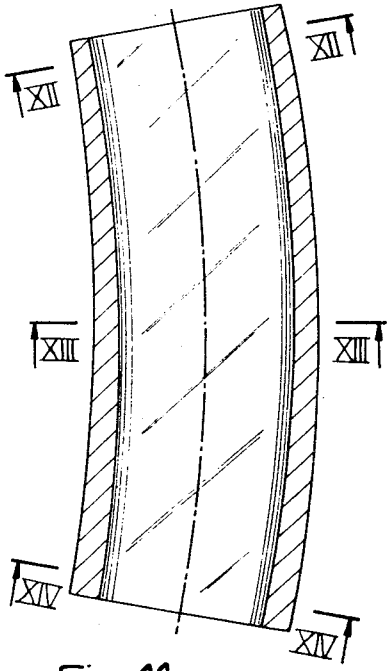
FIGS. 11, 12, 13 and 14 show respectively a longitudinal section and cross-sections through the chill obtained by the method.
Figure 12:
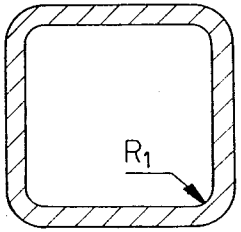
Figure 13:
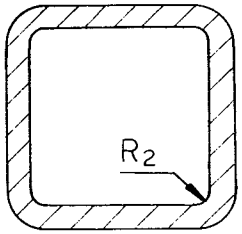
Figure 14:
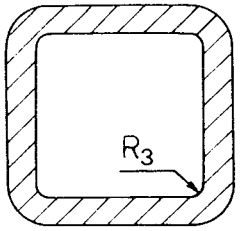

The method of the invention uses a tubular copper or copper-alloy semi-finished product of rectilinear axis, of the type shown in FIG. 1.

Figure 4:
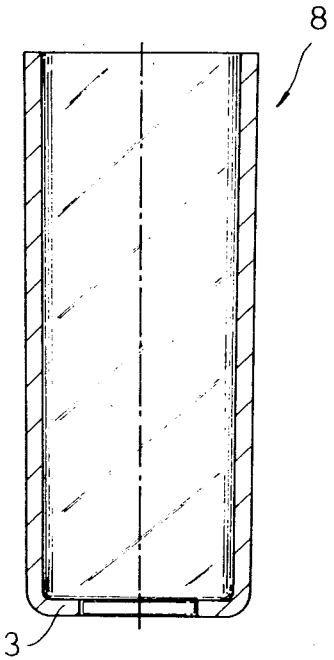

The method comprises a first stage in which an end 2 of the semi-finished product 1 is turned-over by cold plastic deformation in order to form an annular shoulder 3 at said end, as shown in FIG. 4, which represents the semi-finished product obtained at the end of said stage.

Figure 2:
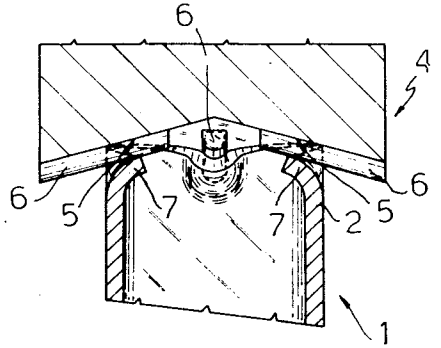
Figure 3:
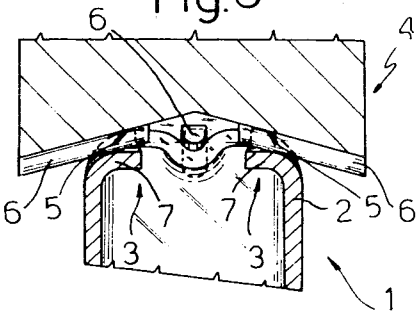

Although said shoulder can be obtained in any convenient manner by a cold plastic deformation operation, it is convenient to form it by the operations shown diagrammatically in FIGS. 2 and 3. These operations consist substantially of exerting, on the end 2 of the semi-finished product, firstly localised pressures so as to create deformations of said end in predetermined zones, and then a pressure on the entire end so as to turn it over and create the annular shoulder 3, using for this purpose a tool 4 provided with working surfaces 5 and a plurality of projecting blades 6, and which moves axially towards said semi-finished product. As can be clearly seen in FIG. 2, in which it is assumed that said first stage is to be used for turning-over the end 2 of a semi-finished product of substantially square cross-section, the working surfaces 5 of said tool are substantially flat and disposed in accordance with the lateral surface of a pyramid. A blade 6 projects from a position corresponding with each of said surfaces. During the first part of the axial movement of the tool 4 towards the semi-finished product 1, each blade creates a localised deformation in the zone indicated by 7, and as the movement of the tool towards said semi-finished product proceeds, the end 2, by virtue of the facilitation provided by said first bent zones, is easily turned-over by sliding it along the working surfaces 5, as is clearly seen in FIG. 3. The semi-finished product 8 obtained at the end of said first stage is shown in FIG. 4.

Figure 5:
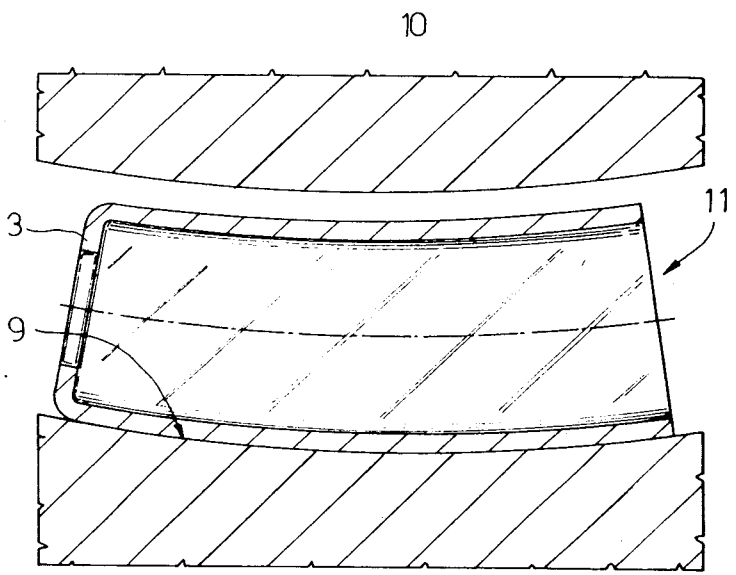

The method then comprises a second stage in which the semi-finished product 8 is shaped in order to give it a curved form, by which its longitudinal axis assumes a shape for example in the form of a circumferential arc. As shown clearly in FIG. 5, this stage is effected by exerting substantially radial pressures on the outer surface of the semi-finished product 8. These pressures can be exerted effectively by means of a mould comprising substantially a support surface 9 and a mobile part 10 to be moved towards this latter.

In the third stage of the method, a mandrel 12, of the same shape and outer dimensions as the chill to be prepared, is inserted into the semi-finished product 11 thus obtained. In this stage, the lower end of the mandrel is made to rest on the annular shoulder 3, as shown clearly in FIG. 6. The inner dimensions of the starting semi-finished product 1 of rectilinear axis shown in FIG. 1 are chosen such that the inner dimensions of the semi-finished product 11 used in said third stage are substantially greater than the maximum dimensions of the mandrel 12, so as to leave a predetermined radial gap g between the mandrel and semi-finished product. It has been found that for the purposes described hereinafter, the said gap must be fairly large.

The presence of this gap firstly results in the advantage of being able to easily insert the mandrel 12 into the semi-finished product 11 without the lower end of the mandrel interfering with the inner surfaces thereof and thus damaging them.

In the fourth stage of the method, the unit formed from the semi-finished product 11 and the mandrel 12 disposed therein is passed through an extruder die 15 (FIG. 7) of dimensions such as to deform the material of said semi-finished product and cause the inner surface thereof to closely adhere to the outer surface of the mandrel. This stage is effected by exerting a substantially axial force on the mandrel so that said force becomes transmitted to the semi-finished product by virtue of the resting of the mandrel on the annular shoulder 3. As can be seen in the diagrammatic illustration of FIG. 7, during said fourth stage the upper end 16 of the mandrel substantially undergoes continuous swivelling in the plane containing the arc-shaped axis of said mandrel, and the die 15 also undergoes continuous swivelling in the same plane about an axis indicated by the dashed line 17.

Figures 6, 7, 8:
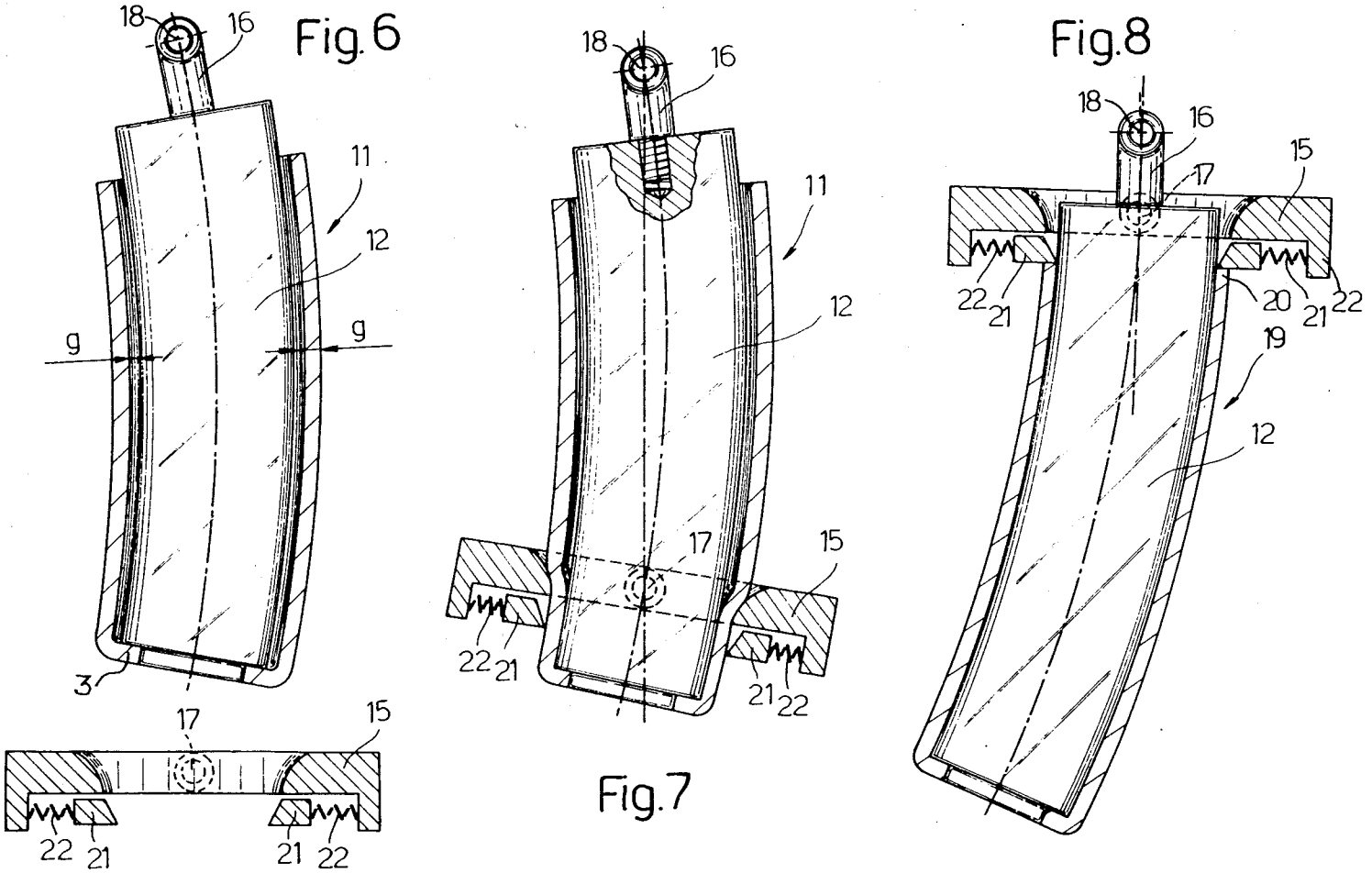

During said stage, because of the dimensional reduction to which the cross-section of the semi-finished product 11 is subjected as it passes through the die 15, not only does the inner surface thereof assume the same shape as the outer surface of the mandrel, but there is also a considerable work-hardening of the material of said surface, which gives it considerable hardness and thus high wear-resistance. It has also been found that if the extrusion effected in said fourth stage takes place with fairly large gaps present between the mandrel 12 and semi-finished product 11, the inner surface of the semi-finished product strictly assumes the shape of the outer surface of the mandrel, and simultaneously the material of said surface assumes a very high degree of hardness. In this respect, only if such gaps are present is the material of the semi-finished product 11, in passing from its initial to its final configuration, subjected to radial and axial displacements of considerable extent, produced by the action of the radial and axial pressures exerted by the mouth of the die on the outer surface of the semi-finished product being processed. FIG. 8 shows the unit formed from the semi-finished product and mandrel at the end of said fourth stage.

The method also comprises a fifth stage in which when the semi-finished product 11 has passed through the die 15, a substantially axial force is exerted on the mandrel 12 in the opposite direction to the force exerted in the preceding stage. During this stage, the end edge 20 of the semi-finished product is rested against counteracting sectors 21 disposed below the die 15 and mobile towards the mandrel 12. It is thus apparent that by the action of the indicated force, the mandrel 12 can be withdrawn from the semi-finished product 19, which is kept in a fixed position by the action of the sectors 21. Conveniently, these can be controlled by operating means able to operate completely automatically, for example springs 22 (FIG. 9).

In order to obtain the finished chill, it is necessary only to cut off an end portion of the semi-finished product 19 in order to remove the shoulder 3, as shown in FIG. 10, and then subject it to further treatment, in particular depositing a layer of lining material on its inner surface (chromium plating or the like).

The chill obtained in this manner possesses numerous favourable properties. Firstly, the shape of its inner surface is rigorously correct. This is due to the perfect engagement between the mandrel 12 and semi-finished product 11 during the fourth stage of the method (FIG. 7). This favourable characteristic is due not only to the presence of the gaps g between the mandrel 12 and semi-finished product 11 which induce movements in the material of said semi-finished product, but also to the correct extrusion action which can be effected on the semi-finished product 11 by the action of the mandrel 12 due to the resting of said mandrel on the annular shoulder 3, and to the conditions of engagement between said mandrel and the die 15, which can swivel respectively about the axes 18 and 17 (FIG. 7). Moreover, because of said extrusion action, the inner surface of the chill has a high degree of hardness and is in a suitable state for receiving a layer of lining material with high wear resistance. Finally, the inner cross-section of the chill can be varied along its axis in accordance with any required relationship by gradually reducing said cross-section as shown in the sectional views of FIGS. 12, 13 and 14, and in particular the connection radii $R_1$, $R_2$ and $R_3$ between the sides of the cross-sections can gradually decrease in order to attain optimum conditions for the passage of the molten steel in said chill.

Modifications can obviously be made to the described stages of the present method but without leaving the scope of the invention.

I claim:

1. A method of preparing tubular chills having a wall thickness of decreasing dimension, comprising the steps of:

(a) providing a tubular element;

(b) forming an annular shoulder at a first end of said element;

(c) shaping said element into curvilinear form;

(d) inserting into a second end of said element a mandrel so that a first end of said mandrel rests on said shoulder, said mandrel having an axially decreasing outer diameter corresponding to the shrinkage of solidifying molten metal as it passes through the chill less than the inner diameter of said element for therewith creating a radial gap;

(e) providing an extrusion die;

(f) inserting said annular shoulder into said die and ironing said element with said mandrel through said die and thereby causing said element to be deformed so that the inner surface thereof adheres to the outer surface of said mandrel so that said deformed element has a wall thickness of axially increasing dimension complementary with the axially decreasing diameter of said mandrel;

(g) removing said mandrel from said element; and, (h) severing said shoulder from said element.

2. The method of claim 1, including the step of:

(a) providing a tubular element comprised of copper.

3. The method of claim 1, including the step of:

(a) deforming said first end of said element by cold plastic deformation.

4. The method of claim 1, including the step of:

(a) shaping said element into curvilinear form of constant radius.

5. The method of claim 4, including the step of:

(a) applying pressure to said element orthogonal to the axis of said element for achieving said curvilinear form.

6. The method of claim 5, including the step of:

(a) providing a mold for applying pressure to said element orthogonal to the axis of said element.

7. The method of claim 1, including the step of:

(a) swivelling said die in conformance with said curvilinear form as said element is passed therethrough.

8. The method of claim 7, including the steps of:

(a) providing tube end engaging means downstream of said die;

(b) passing said element through said die so that said second end thereof opposite said first end engages said tube end engaging means and thereby prevents said element from moving in a direction opposite to that moved in during passage through said die; and, (c) exerting a force on said mandrel directed opposite to the force exerted for passing said element through said die and thereby extracting said mandrel from said element.

9. The method of claim 8, including the step of:

(a) mounting said tube end engaging means to said die.

10. The method of claim 1, including the step of:

(a) cutting-off said element first end.

11. A method of preparing tubular copper chills having an axially decreasing wall thickness, comprising the steps of:

(a) providing a tubular element comprised of copper having constant wall thickness;

(b) deforming a first end of said element through cold plastic deformation and thereby forming an annular shoulder;

(c) applying pressure to said element orthogonal to the axis thereof and thereby shaping said element into curvilinear form of constant radius;

(d) providing a mandrel having a first end of a first diameter and a second end of a second diameter exceeding said first diameter and said mandrel increasing in diameter between said first and second ends;

(e) inserting said mandrel first end into a second end of said element and resting said mandrel first end upon said shoulder, said mandrel having a diameter less than the inner diameter of said element for therewith creating a radial gap;

(g) providing an extrusion die and said die being free to swivel about the center thereof.

(h) inserting said element first end into said die and passing said element with said mandrel through said die and thereby progressively ironing said element so that the inner surface thereof adheres to the outer surface of said mandrel whereby said deformed element has diminishing wall thickness between said shoulder and said second end;

(i) extracting said mandrel; and, (j) severing said element first end.

12. The method of claim 11, including the steps of:

(a) providing a mold; and, (b) inserting said element into said mold and causing said mold to exert pressure on said element orthogonal to the axis thereof for forming said element into curvilinear shape.

13. The method of claim 11, including the step of:

(a) cutting off said element first end.

14. The method of claim 11, including the steps of:

(a) maintaining said deformed element in position relative to said die after passage therethrough; and, (b) extracting said mandrel through application of a force directed opposite to the direction in which said element was moved during passage through said die.

15. The method of claim 14, including the step of:

(a) providing said die with means for engaging an end of said element for thereby maintaining said element in position after deformation.

* * * * *